United States Patent [19]

Prietzel et al.

[11] Patent Number: 4,486,636

[45] Date of Patent: Dec. 4, 1984

[54] BREAK CONTACT ARRANGEMENT FOR PULLOUT-TYPE SWITCHGEAR

[75] Inventors: Günter Prietzel; Rosemarie Shultz, both of Berlin, Fed. Rep. of Germany

[73] Assignee: Siemens Aktiengesellschaft, Munich, Fed. Rep. of Germany

[21] Appl. No.: 533,736

[22] Filed: Sep. 19, 1983

[30] Foreign Application Priority Data

Sep. 30, 1982 [DE] Fed. Rep. of Germany ..... 3236495

[51] Int. Cl.[3] ..... H01H 1/44

[52] U.S. Cl. ..... 200/255; 200/282; 339/255 P

[58] Field of Search ..... 200/48 KB, 162, 163, 200/255, 256, 257, 258, 260, 282; 339/255 P, 64

[56] References Cited

U.S. PATENT DOCUMENTS

| | | | |
|---|---|---|---|
| 2,273,069 | 2/1942 | Rossman | 200/255 |
| 2,303,425 | 12/1942 | Bickham | 200/163 |
| 2,376,818 | 5/1945 | Rubel | 200/163 |
| 2,433,115 | 12/1947 | Green | 200/282 |
| 2,751,471 | 6/1956 | Wills | 200/163 |
| 2,872,659 | 2/1959 | Wills | 339/255 P |
| 3,201,556 | 8/1965 | Baird | 200/282 |
| 3,427,419 | 2/1969 | Findley, Jr. | 200/255 |
| 3,982,806 | 9/1976 | Wilson et al. | 339/255 P |

FOREIGN PATENT DOCUMENTS

| | | | |
|---|---|---|---|
| 1092988 | 11/1960 | Fed. Rep. of Germany . | |
| 1149782 | 6/1963 | Fed. Rep. of Germany . | |
| 2165940 | 7/1973 | Fed. Rep. of Germany . | |
| 2851738 | 6/1980 | Fed. Rep. of Germany . | |
| 1541812 | 9/1968 | France | 200/282 |
| 1598251 | 9/1981 | United Kingdom . | |

*Primary Examiner*—John W. Shepperd

*Attorney, Agent, or Firm*—Kenyon & Kenyon

[57] ABSTRACT

A break contact arrangement is disclosed. One piece spacers provided with angled-off arms determine the mutual spacing of contact segments and guide the contact segments within a holder comprising side walls and sheet metal covers. The contact segments are spaced by the arms of the spacers. Each spacer includes a U-shaped central portion which is received in a recess of the contact segments and extensions at opposite ends which are fastened to the side walls of the holder. The contact forces are supplied by one-piece springs which have spring arms for each contact segment. The break contact arrangement is particularly well suited for pull-out-type low-voltage and medium-voltage switchgear for connecting conductors of rectangular cross section.

11 Claims, 11 Drawing Figures

BREAK CONTACT ARRANGEMENT FOR PULLOUT-TYPE SWITCHGEAR

BACKGROUND OF THE INVENTION

The present invention relates to a break contact arrangement for pullout-type electrical switchgear for connecting opposed conductor ends.

U.S. Pat. No. 4,315,122 discloses a contact arrangement which includes female contact sections arranged between the end portions of a U-shaped support. The contact sections and the U-shaped support are connected at one of their ends to a contact support by two bolts which pass through the contact support and are arranged perpendicularly thereto. A spring arrangement is provided for self-centering the female contact sections relative to a male knife blade contact. The contact segments are formed by stacked punched parts which are held together by the bolts. Two of these connecting bolts go through each group of contact segments. The contact segments are therefore not movable independently of each other which under some circumstances can lead to locally different contact pressures.

OBJECTS AND SUMMARY OF THE INVENTION

It is an object of the present invention to provide a break contact arrangement which can be produced economically, i.e., comprises as few parts as possible, and which has a high current-carrying capacity.

The above and other objects are achieved according to the invention by a break contact arrangement which includes groups of bridge-like contact segments engaging the conductors therebetween, one piece spacers having spacer arms arranged between the contact segments, one piece springs having spring arms each supplying contact pressure to a contact segment and a holder for receiving the contact segments, the spacers and the springs. A spacer is provided for each group of contact segments as an integral, one-piece part with two rows of arms extending between the contact segments, and a spring member is provided for each group of contact segments as an integral, one-piece part having a central web and spring arms extending therefrom for suppling contact pressure to individual contact segments.

The multi-arm spacers make independent displacement of the contact segments possible while maintaining the desired spacing of the contact segments. Each contact segment is thereby contacted with the conductors to be connected independently of adjacent contact segments. The multi-arm spring provides the desired contact pressure at the contact points of each contact segment even though it is of one piece.

The multi-arm spring can be supported in the holder of the break contact arrangement by cooperating structure of the holder and spring. The holder can have a projection arranged transversely to the contact segments which acts as a centering abutment for a central web of the spring which is provided with a corresponding depression. The spring arms of the spring extend to and engage the contact segments close to the contact-making ends thereof. The spring forces thus advantageously act off-center on the contact segments.

According to an aspect of the invention, each spacer has a central portion of approximately U-shaped cross section with extensions at opposed ends for engagement in corresponding openings of the holder. The U-shaped central portion includes a central web to which the extensions are connected and legs extending transversely from opposed sides of the web. The arms of each spacer extend from the legs at an acute angle to the legs. Each contact segment includes a cut-out or recess disposed between the ends of the segment, preferably centered, and the U-shaped central portion of a spacer is disposed in the recess. The spacer thereby can provide guidance of the contact segments vis-a-vis forces generated when the segments are slipped onto a conductor, and ensure proper positioning of the contact segments within the holder.

It has been found advantageous to shape the recess in each contact segment to allow rotation or tilting of the contact segments, and to make the depth of the recess correspond with a permissible deflection of the spring arms. According to one embodiment, the recess has a bottom wall having a convex portion and side walls having a convex portion. The contact segments can then accommodate to a considerable extend different positions of the conductors because the contact segments as well as the springs can rotate or tilt. Damage to the springs is however avoided.

The holder of the break contact arrangement can comprise two side walls extending parallel to the plane of the contact segments having openings for the passage of extensions of the spacers, and two metal covers which supplement the side walls in frame fashion. The projection mentioned above for centering the spring can comprise an inwardly directed dimple in each side wall arranged transversely to the contact segments and the corresponding depression in the spring can be spherical. The holder can be formed by flat stamped parts, which facilitates manufacture of the holder and assembly of the break contact arrangement.

The side walls of the holder can have posts or tabs extending in the direction of the sheet metal covers while the sheet metal covers have openings for passage of the tabs therethrough. The assembly of a break contact arrangement can then be carried out by first putting the parts constituting the arrangement together in a fixture, supplying the pressure required for tensioning the spring members and then peening the tabs over or riveting them.

The sheet metal covers are preferably made from non-magnetic steel which contains one or more of chromium, nickel and titanium as alloying components. As compared to other non-magnetic materials, such steels have the advantage of greater mechanical strength.

The side walls of the holder can be provided with extensions for fastening the break contact arrangement to a switch or to a stationary part.

The extensions can have elongated holes for receiving pins which extend through the legs of fastening brackets. In another fastening arrangement, side walls are provided which have in the vicinity of one end of each group of contact segments a cut-out which is engaged by a holding strip which extends approximately at right angles to the plane of the conductors. The side walls can have convex extensions on the side facing a contact surface.

The above contact arrangements are characterized by the small number of parts required.

The above and other objects, features, aspects and advantages of the present invention will be more readily perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which.

DESCRIPTION OF THE PREFERRED EMBODIMENTS

Figure 1:
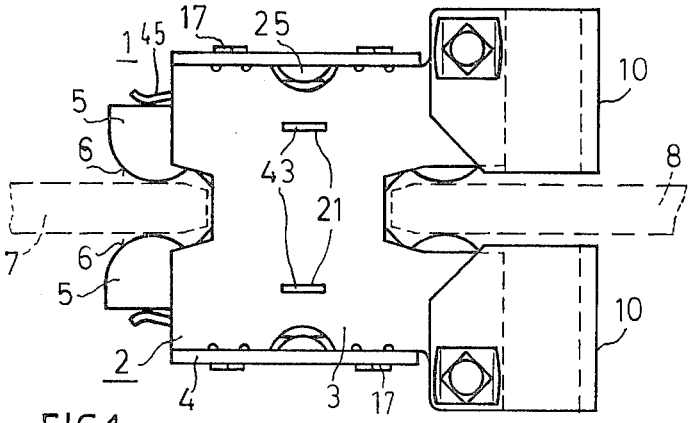
FIG. 1 is a side view of a break contact arrangement according to the invention.
Figure 2:
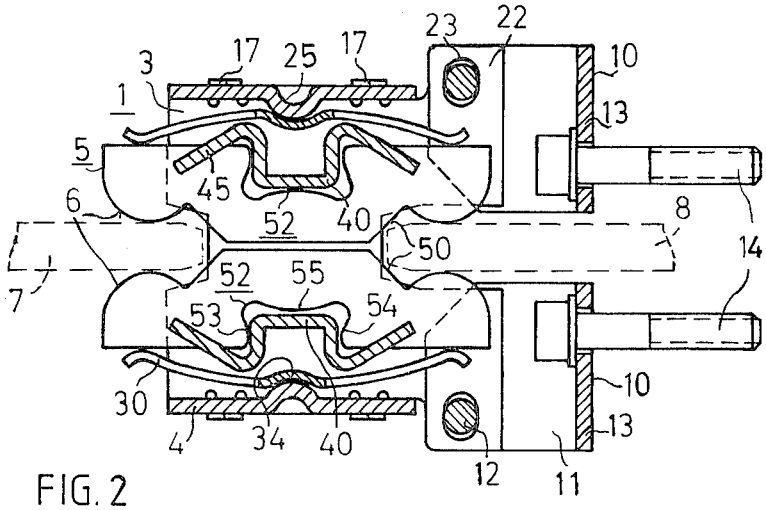
FIG. 2 is a cross-section view of the break contact arrangement of FIG. 1.
Figure 3:
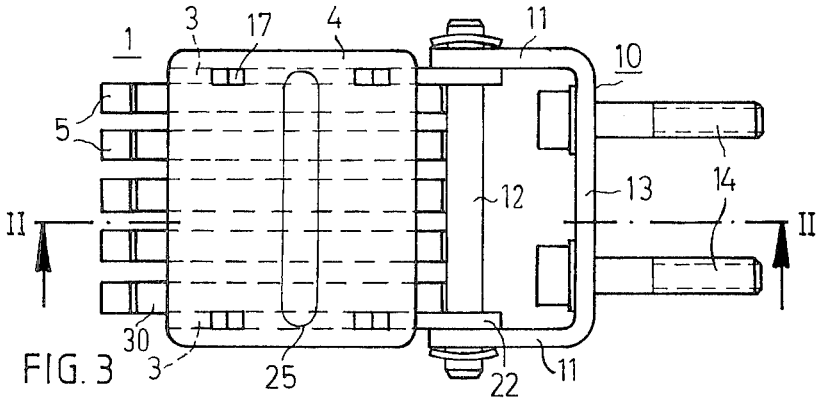
FIG. 3 is a top view of the break contact arrangement of FIG. 1.

The break contact arrangement 1 shown in FIGS. 1, 2 and 3 is especially suited for use in low-voltage circuit breakers as a pullout-type break contact. Switchgear of this type as well as corresponding guiding parts and switchgear suitable for use in low voltage circuit breakers and guiding parts therefor are generally known and are therefore not described in detail herein. The break contact arrangement 1 has a frame-like holder 2 which comprises two identical side walls 3 and two identical sheet metal covers 4. Within the holder 2 there are two opposite groups of five bridge-like contact segments or strips 5 between which conductors 7 and 8, shown dashed, are received and contacted. In use, the break contact arrangement 1 will normally always be in contact with one of the two conductors. The break contact arrangement 1 may be attached to switchgear or to the stationary part of a switching facility. The break contact arrangement can be fastened to a mounting structure by two brackets 10 as shown in FIGS. 1–3, which are fastened together and to the contact arrangement with play by pins 12 which go through the side walls 3 of the contact arrangement and the legs 11 of the brackets. The brackets themselves are fastened to the mounting structure by two screws 14 going through the central part 13 of each bracket 10.

Figure 8:
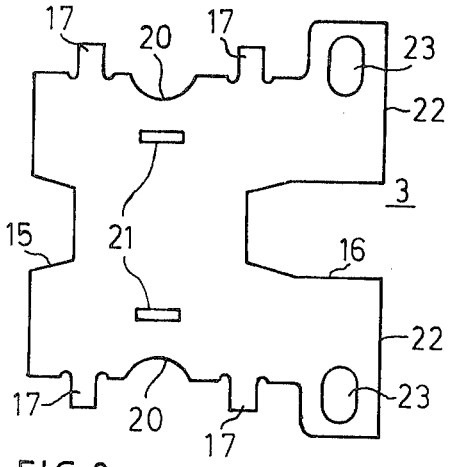
FIG. 8 is a top view of one embodiment of a side wall of a holder of the break contact arrangement of FIG. 1.

As may be seen particularly from FIG. 8, the side walls 3 of the holder 2 are flat, stamped, sheet metal parts. Cutouts 15 and 16 are provided on opposite sides of each sheet metal part. Cut-outs 15 in opposite sheet metal parts are for conductor 7 and cut-outs 16 are for conductor 8, as shown in FIG. 1. Thus, on each side of each conductor is disposed a cut-out so that the break contact arrangement 1 can cooperate with conductors which are wider than the holder 2, and lateral offsetting of the conductors with respect to each other is permissible within certain limits. The side wall 3 at its top edge and its bottom edge has two tabs 17 which are provided for connecting the side walls 3 to the sheet metal covers 4, as will be described below. Between the tabs 17 there is disposed an approximately semicircular cut-out 20 for receiving extensions of a spacer, as will be described below. The side walls 3 are further provided with two openings 21 which lie on a line connecting the center of the cut-outs 20. In the vicinity of the cut-out 16, the side walls 3 are provided with two extensions 22 in each of which an elongated hole 23 is provided.

Figure 9:
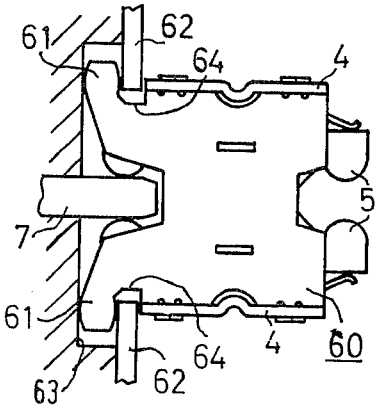
FIG. 9 is a side view of a contact arrangement similar to that of FIG. 1 showing another embodiment of a side wall together utilizing holding strips.

In the embodiment of FIG. 9, the side walls 60 have extensions 61 which are without elongated holes. Instead, two holding strips 62 are provided for fastening the break contact arrangement which extend parallel to a contact surface 63 and are fastened to a mounting structure in a suitable manner, not shown in detail. A cut-out 64 cooperating with these holding strips is provided on each side wall 60 in the vicinity of the end facing the contact surface 63 of each group of contact segments 5. In the embodiment shown in FIG. 9, the cut-outs are disposed between the extensions 61 and the metal covers 4. The position of the holding strips 62 and the depth of the cut-outs 64 are matched to each other such that the break contact arrangement can be moved in the direction of an offset of the conductor to compensate for tolerances that might occur. A convex shape of the sides of the extension 61 which face the contact surface 63 enable frictionless sliding motion of the contact arrangement relative to the mounting structure. The surfaces of the extensions facing the holding strips 62 also have a convex shape.

Figure 10:
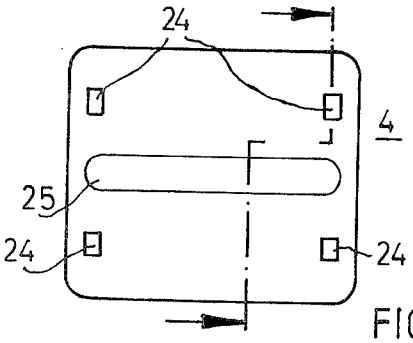
FIG. 10 is a top view of a sheet metal cover of a holder of the break contact arrangement of FIG. 1.
Figure 11:
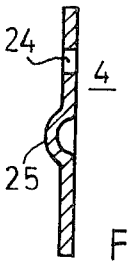
FIG. 11 is a cross-section view of the cover of FIG. 10.

As shown in FIGS. 10 and 11, the sheet metal covers 4 which can be connected to the side walls 3 are substantially rectangular having rounded corners and four openings 24 provided for the tabs 17 of the side walls 3 to pass through. Disposed approximately in the middle of the cover 4 between the openings 24 is a dimple 25 of approximately semi-circular profile, whose purpose will be described below.

In order to avoid undesirable heating of the break contact arrangement during operation, the sheet metal covers are made of a non-magnetic steel including one or more of chromium, nickel and titanium as alloying components. Covers made of such materials also have very high mechanical strength. In the embodiment of FIGS. 10 and 11, mechanical strength is increased due to a stiffening effect caused by the dimple 25. Conversely, the side walls 3 according to FIG. 8 or the side walls 60 according to FIG. 9 could be made of a non-magnetic steel while the sheet metal covers are made of normal, magnetic structural steel.

Figure 4:
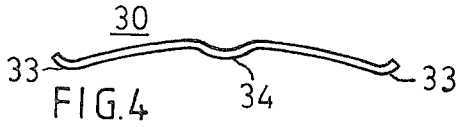
FIG. 4 is an end view of a multi-armed spring member forming part of the contact arrangement of FIG. 1.
Figure 5:
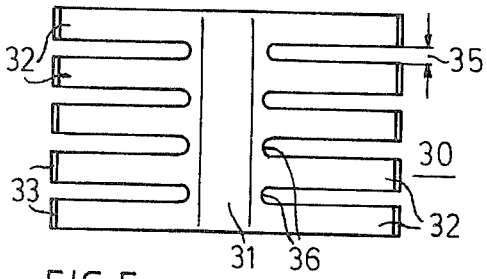
FIG. 5 is a top view of the spring member of FIG. 4.

The contact pressure required for a lossless current transition from the contact segments 5 to the conductors 7 and 8 is supplied by the multi-armed, leaf-spring members 30 shown in FIGS. 4 and 5. The spring members 30 have a central web 31 and spring arms 32 which project symmetrically from both sides of the web. In its relaxed condition shown in FIGS. 4 and 5, the spring member 30 forms substantially a section of a circle with the ends 33 of the arms curved at a smaller radius than that of the overall spring in a direction opposite to the main curvature of the spring. A portion 34 disposed in the web 31 is also curved at a smaller radius than that of the overall spring in a direction opposed to that of the main curvature. Spaces 35 between adjacent spring arms 32 corresponds to the spaces between the contact segments 5. The transitions 36 from one arm to the adjacent arm in the spring members 30 are rounded in order to avoid a notch effect. The spring members 30 can be produced from sheet material of a suitable nature (e.g. spring steel) by one or more stamping and embossing operations.

Figure 6:
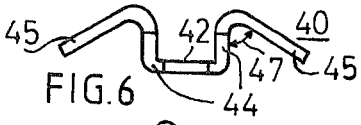
FIG. 6 is an end view of a multi-armed spacer forming part of the contact arrangement of FIG. 1.
Figure 7:
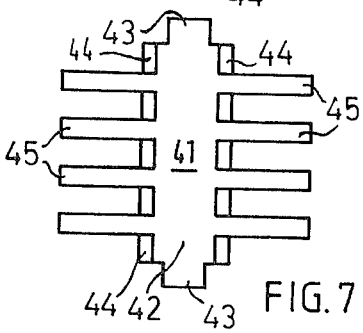
FIG. 7 is a top view of the spacer of FIG. 6.

The break contact arrangement 1 further includes a spacer 40 shown in FIGS. 6 and 7. The spacer 40 has an approximately U-shaped central portion 41, the web or bottom 42 of which includes extensions 43 at both ends which are received in openings 21 of side walls 3. Legs 44 of the central portion 41 extend transversely from the bottom 42 and arms 45 having a width corresponding to the spaces between the contact segments 5 symmetrically extend from legs 44 on both sides of the central portion. Accordingly, the spacing of the arms 45 corresponds to the width of the contact segments 5. As shown in FIG. 6, the arms 45 are bent outwardly such that they form an acute angle 47 with the legs 44 of the central portion 41. The spacer 40 can also be made from a suitable sheet material (e.g. spring steel) as a punched and bent part.

Contact segments 5 are shaped as shown in FIG. 2 and described below and cooperate with other parts as described below. Each contact segment 5 includes between the curved contact surfaces 6 a projecting center section 50 which contacts an identical center section 50 of an opposite contact segment 5 when the conductors 7 and 8 are not inserted into the contact arrangement. Such center sections position the contact surfaces 6 opposite each other with a spacing which is less than the thickness of the conductors 7 and 8. In this position, the contact segments 5 are pretensioned by the spring arms of the spring members 30. Each of the spring members is braced with its central web 31 against the dimple 25 of the sheet metal covers 4, thereby providing a spherical contact of a spring member against a cover which centers each spring member 30 and secures it against lateral displacement in cooperation with the curvature 34 of the central web 31 of the spring member 30. At the same time, the dimple 25 substantially increases the strength of the central web against bending. The length of the spring arms 32 is made so that the points of contact of the bent ends 33 are close to the ends of the contact segments 5.

The contact segments 5 further have, on their side facing the spring members 30, a cut-out or recess 52 which is basically of rectangular shape with convex side walls 53, 54 and a convex bottom wall 55. The central portion 41 of the spacer 40 is received in the recesses of the contact segments and the spacer guides each contact segment 5 thereby. The convex shape of the walls allows a tilting or rotary motion of the contact segments without canting in the plane of the conductors. The depth of the recess 52 is chosen so that spreading of the contact segments is limited and excessive rotation of the spring members 30 is avoided in spite of the rotating motion of the contact segments. The spacers 40 are supported in the side walls 3 by their extensions 43 in openings 21 and thereby hold the contact segments 5 securely against forces which occur during insertion and removal of switching equipment. The contact segments 5 are further supported against each other by the arms 45 of the spacers 40.

As shown in FIGS. 1, 2 and 3, the side walls 3 are connected to the sheet metal covers 4 by the tabs 17 of the side walls 3 which extend through the openings 24 of the sheet metal covers 4 and are riveted or peened over at their ends. The dimple 25 is received in the cut-outs 20 in the side walls 3.

If the break contact arrangement 1 described above is fastened by screws 14 to the stationary part of a switching facility, for example, the holder 2 can nevertheless move to a certain extent relative to the brackets 10, due to the elongated holes 23. This enables the holder 2 with the contact segments 5 to be aligned with the conductor shown in FIG. 1. Even if the conductors 7 and 8 are not aligned exactly because the contact segments 5 and the spacers 40 intentionally do not provide exact parallel guidance, the contact pressures at the contact surfaces 6 will remain approximately the same and the spring members 30 can accommodate a change of the angular position due to the spherical support of the springs at the dimple 25.

The contact arrangement has essentially no laterally protruding portions. As a result, two or more identical contact arrangements can be installed side by side without a loss of space, thereby increasing the rated current while the specific stress remains the same. In addition, the contact arrangement described above can have different numbers of contact segments by simply matching sheet metal covers 4, spring members 30 and spacers 40.

Certain changes and modifications of the embodiments of the invention disclosed herein will be readily apparent to those skilled in the art. It is the applicants' intention to cover by the claims all those changes and modifications could be made to the embodiments of the invention herein chosen for the purpose of disclosure without departing from the spirit and scope of the invention.

What is claimed is:

1. A break contact arrangement for pullout-type electrical switchgear for connecting conductors having oppositely-disposed ends, comprising a first plurality of spaced, adjacently disposed contact segments each having opposed ends, a second corresponding plurality of spaced, contact segments each having opposed ends and each disposed opposite to a respective contact segment of said first plurality to define a corresponding plurality of oppositely disposed contact segments, respective ends of oppositely disposed contact segments cooperating to receive a respective conductor, a one piece spacer disposed adjacent each plurality of contact segments having a central portion extending across the respective plurality of contact segments and a plurality of spacer arms extending outwardly from the central portion in the direction of the contact segments for a substantial distance along and between adjacent contact segments, a one piece spring disposed adjacent each spacer having a plurality of spring arms extending into contact with respective contact segments, and a holder for receiving the contact segments, the springs and the spacers in a cooperating manner with the spring arms tensioning the contact segments.

2. The break contact arrangement according to claim 1 wherein the holder includes a shaped central portion extending transversely to each plurality of contact segments and the spring includes a correspondingly shaped central portion, the shaped portions cooperating to provide a centering abutment for each spring.

3. A break contact arrangement for pullout-type electrical switchgear for connecting conductors having oppositely-disposed ends, comprising a first plurality of spaced, adjacently disposed contact segments each having opposed ends, a second corresponding plurality of spaced, contact segments each havcing opposed ends and each disposed opposite to a respective contact segment of said first plurality to define a corresponding plurality of oppositely disposed contact segments, respective ends of oppositely disposed contact segments cooperating to receive a respective conductor, a one piece spacer disposed adjacent each plurality of contact segments having a plurality of spacer arms extending between adjacent contact segments, a one piece spring disposed adjacent each spacer having a plurality of spring arms extending into contact with respective contact segments, and a holder for receiving the contact segments, the springs and the spacers in a cooperating manner with the spring arms tensioning the contact segments, each spacer including a central portion of approximately U-shaped cross section having extensions at opposed ends and the holder including openings in which are engaged the extensions, the central portion of each spacer comprising a web and legs projecting transversely from edges of the web, the spacer arms extending at an acute angle from the legs, and each contact segment including a recess disposed between the ends of the contact segment in which the central portion of the associated spacer is received.

4. The break contact arrangement according to claim 3 wherein the recess includes convex walls which permit rotary motion of the contact segments and define a permissible deflection of the spring arms.

5. A break contact arrangement for pullout-type electrical switchgear for connecting conductors having oppositely-disposed ends, comprising a first plurality of spaced, adjacently disposed contact segments each having opposed ends, a second corresponding plurality of spaced, contact segments each having opposed ends and each disposed opposite to a respective contact segment of said first plurality to define a corresponding plurality of oppositely disposed contact segments, respective ends of oppositely disposed contact segments corresponding to receive a respective conductor, a one piece spacer disposed adjacent each plurality of contact segments having a plurality of spacer arms extending between adjacent contact segments, a one piece spring disposed adjacent each spacer having a plurality of spring arms extending into contact with respective contact segments, a holder for receiving the contact segments, the springs and the spacers in a cooperating manner with the spring arms tensioning the contact segments, the holder comprising two side walls having openings arranged parallel to the plane of the contact segments, each spacer having opposed extensions which pass through the openings, and two covers extending transversely to said side walls and forming a frame with the side walls, a dimple disposed on each cover extending transversely to the contact segments and directed inwardly, each of the springs being provided with a corresponding depression into which the dimple extends.

6. The break contact arrangement according to claim 5 wherein the side walls have tabs extending in the direction of the covers which have openings through which the tabs pass.

7. The break contact arrangement according to claim 5 wherein the covers are made of a non-magnetic steel alloy containing at least one of chromium, nickel and titanium.

8. The break contact arrangement according to claim 5 wherein the side walls of the holder have extensions for fastening the arrangement to switchgear or to a stationary part.

9. The break contact arrangement according to claim 8 wherein the extensions are provided with elongated holes for receiving pins which mount the arrangement to a fastening bracket.

10. The break contact arrangement according to claim 5 wherein the side walls each have a recess in the vicinity of one of the ends of each plurality of contact segments adapted to receive a strip which extends approximately at right angles to the plane of the conductor for fastening the contact arrangement to a mounting structure.

11. The break contact arrangement according to claim 10 wherein the extensions are convex on their side facing the conductor.

* * * * *